US006210850B1

(12) United States Patent
Ogata et al.

(10) Patent No.: US 6,210,850 B1
(45) Date of Patent: Apr. 3, 2001

(54) CARRIER FOR ELECTROPHOTOGRAPHIC DEVELOPER AND ELECTROPHOTOGRAPHIC DEVELOPER CONTAINING THE SAME

(75) Inventors: Masahiro Ogata; Kazunori Takagi; Takao Sugiura, all of Chiba-ken; Yuji Yoshikawa; Masaaki Yamaya, both of Gunma-ken, all of (JP)

(73) Assignee: Powdertech Co., Ltd., Chiba-ken (JP)

( * ) Notice: Subject to any disclaimer, the term of this patent is extended or adjusted under 35 U.S.C. 154(b) by 0 days.

(21) Appl. No.: 09/477,798

(22) Filed: Jan. 5, 2000

(30) Foreign Application Priority Data

Feb. 16, 1999 (JP) ..... 11-037091

(51) Int. Cl.[7] ..... G03G 9/113
(52) U.S. Cl. ..... 430/108
(58) Field of Search ..... 430/106, 108

(56) References Cited

U.S. PATENT DOCUMENTS 5,079,124 * 1/1992 Kawata et al. ..... 430/108
5,652,079 * 7/1997 Mochizuki et al. ..... 430/108

FOREIGN PATENT DOCUMENTS

| | | |
|---|---|---|
| 0 405 503 | 1/1991 | (EP) . |
| 0 932 083 | 7/1999 | (EP) . |
| 55-157751 | 12/1980 | (JP) . |
| 2-160259 | 6/1990 | (JP) . |
| 7-104522 | 4/1995 | (JP) . |
| 8-234501 | 9/1996 | (JP) . |
| 63-174054 | 7/1998 | (JP) . |

* cited by examiner

*Primary Examiner*—John Goodrow
(74) *Attorney, Agent, or Firm*—Young &Thompson

(57) ABSTRACT

A resin-coated carrier for an electrophotographic developer which comprises a carrier core coated with an acryl-modified silicone resin the silicone resin of which has a methyl group and other organic groups, the molar ratio of the methyl group to the total organic groups inclusive of the methyl group [methyl group/(methyl group+other organic groups)]being 64 mol % or higher and lower than 70 mol %, and the acrylic resin to silicone resin weight ratio ranging from 2/8 to 4/6.

8 Claims, No Drawings

CARRIER FOR ELECTROPHOTOGRAPHIC DEVELOPER AND ELECTROPHOTOGRAPHIC DEVELOPER CONTAINING THE SAME

BACKGROUND OF THE INVENTION

1. Field of the Invention

The present invention relates to a resin-coated carrier for an electrophotographic developer used in copying or printing machines, particularly for full color image formation and to an electrophotographic developer containing the carrier.

2. Description of the Related Art

A two-component developer used in electrophotography comprises a toner and a carrier. The carrier is mixed and agitated with the toner in a development box to give a desired quantity of charges to the toner and carries the charged toner particles onto an electrostatic latent image formed on a photoreceptor to form a toner image.

The carrier remains on the magnet roll and is returned to the development box, where it is again mixed and agitated with fresh toner particles for repeated use.

Therefore, the carrier is required to exhibit desired characteristics, especially charging properties for toner particles, constantly in any environment over its service life.

Conventional developers, however, undergo a so-called spent-toner phenomenon that toner particles adhere by fusion to the surface of the carrier particles due to the stress of friction and/or collision of carrier particles with each other or with the wall of a development box. The stress also causes a resin coat of carrier particles to separate and fall off the core. On account of these phenomena, the carrier characteristics such as charge quantity and carrier resistance vary, which can result in image deterioration (such as change in image density and fog) or toner scattering.

In order to prevent the deterioration of carrier characteristics, studies have been made on the resin for coating the surface of a carrier. Of various resins proposed to date acrylic resins and silicone resins have now been prevailing.

Acrylic resins exhibit good adhesion to a carrier core, and an acrylic resin-coated carrier has excellent charging ability, particularly for a negatively chargeable toner, and therefore, has been used widely. However, acrylic resin-coated carrier has a disadvantage of poor resistance against the spent-toner phenomenon. A silicone-coated carrier, on the other hand, has poor charging ability, although it is resistant to the spent-toner phenomenon owing to its low surface energy. Recently, an amino-containing silicone-coated carrier has been proposed (Japanese Patent Laid-Open No. 104522/95), in which the charging ability is improved to the level of acrylic resin-coated carriers by incorporating an amino group to the coating silicone resin.

Since a silicon coating layer is highly insulating, a silicone-coated carrier causes the developer to change (increase) the charge quantity during use, which results in variation of image characteristics. Change in image density with an increase of charge quantity during use is very problematical particularly in full color image formation having weight attached to gradation.

Acryl-modified silicone-coated carriers have been proposed as a carrier possessing both the merits of the acrylic resin-coated carrier and the silicone-coated carrier as disclosed in Japanese Patent Laid-Open Nos. 157751/80 and 234501/96. The coated carriers disclosed are excellent in both charging ability and charging stability and superior to the acryl resin-coated one in resistance against the spent-toner phenomenon.

However, the conventional acryl-modified silicone-coated carriers have poor fluidity. In particular, fluidity of those particles having an average particle size as small as 60 $\mu$m or less are so poor that carrier transfer properties on the magnet roll during development are reduced to reduce the ability of developing the photoreceptor with a toner. The poor fluidity also causes non-uniform mixing with toner particles in the development box.

In regards to resistance to a spent phenomenon, the conventional acryl-modified silicone-coated carriers are, while superior to acrylic resin-coated carriers as mentioned above, still inferior to silicone-coated carriers, which is problematic particularly to carrier particles for full color machines which are brought into contact with toner particles more frequently. The aforementioned problems have not been settled as yet.

SUMMARY OF THE INVENTION

An object of the present invention is to provide a carrier for an electrophotographic developer which has high toner charging ability, stable charging properties during development, and excellent resistance against a spent-toner phenomenon, and an electrophotographic developer containing the carrier.

Another object of the invention is to provide a resin-coated carrier for an electrophotographic developer which exhibits satisfactory fluidity, showing satisfactory transfer properties on a magnet roll during development even when it has an average particle size of 60 $\mu$m or even smaller and thereby giving a toner satisfactory developing ability on a photoreceptor, and which also exhibits excellent charging stability against environmental changes, and to provide an electrophotographic developer containing the carrier.

As a result of extensive study, the present inventors have found that the above objects are accomplished by using, as a carrier coating resin, an acryl-modified silicone resin at a specific weight ratio of acrylic resin to silicone resin and a specific molar ratio of methyl group to other organic groups in the silicone resin, to provide a resin-coated carrier having high charging ability and excellent charging stability during development.

Having been completed based on the above finding, the present invention provides a carrier for an electrophotographic developer which comprises a carrier core coated with an acryl-modified silicone resin the silicone resin of which has a methyl group and other organic groups, the molar ratio of the methyl group to all the organic groups inclusive of the methyl group [methyl group/(methyl group+other organic groups)]being 64 mol % or higher and lower than 70 mol %, and the acrylic resin to silicone resin weight ratio ranging from 2/8to 4/6.

The present invention also provides an electrophotographic developer comprising the above-described carrier and a nonmagnetic toner.

The resin-coated carrier for an electrophotographic developer according to the present invention shows high toner charging ability, stable charging properties during development, and excellent resistance to a spent-toner phenomenon. Further, the coated carrier of the present invention has satisfactory fluidity enough to have satisfactory transfer properties on a magnet roll during development even with small particle size of not greater than 60 $\mu$m and to secure satisfactory development on a photoreceptor with a toner, and excellent charging stability against environmental changes. Containing such a carrier, the developer according to the present invention maintains initial image forming characteristics for an extended period of time.

DETAILED DESCRIPTION OF THE INVENTION

In the present invention, an acryl-modified silicone resin is used as a resin for coating a carrier core. The organic groups contained in the silicone resin of the acryl-modified silicone resin include a methyl group and other organic groups. The molar ratio of the methyl group to the total organic groups, inclusive of the methyl group, is 64 mol % or greater than smaller than 70 mol %, preferably 68 to 69 mol %. If the molar ratio of the methyl group is 70 mol % or greater, charging stability against environmental changes is deteriorated. That is, the charge quantity decreases in a high temperature and high humidity environment to cause toner scattering and fogging, or the charge quantity increases in a low temperature and low humidity environment to cause underdevelopment or insufficient image density. If the molar ratio is less than 64 mol %, the coated carrier particles have reduced fluidity. It follows that the toner has reduced developing ability, the resistance to a spent-toner phenomenon reduces, and the carrier characteristics, such as charge quantity and resistance, vary to cause image deterioration (e.g., variation in image density and fog development on a white background) and toner scattering.

It is preferred that the silicone resin of the acryl-modified silicone resin contains a phenyl group in a proportion of 90 mol % or more based on all the organic groups except a methyl group. Where the proportion of a phenyl group is less than 90 mol %, the charging stability against environmental changes tends to be reduced.

The weight ratio of the acrylic resin to the silicone resin in the acryl-modified silicone resin is in the range 2/8to 4/6, preferably 2.5/7.5to 3.5/6.5. If the weight ratio of the modifier resin is less than 2, the coating resin layer is so insulating that the charge quantity increases during development to cause variations in image characteristics. Additionally the toner charging ability particularly for a negatively chargeable toner, are insufficient. If the weight ratio of the modifier resin exceeds 4, the resin-coated carrier particles will have poor fluidity. In particular, where the carrier particles have an average particle size as small as 60 $\mu$m or less, the carrier transfer properties on the magnet roll during development are reduced due to the poor fluidity, which can result in reduction of toner's developing ability on the photoreceptor. In addition, the spent-toner phenomenon resistance is also deteriorated.

The acryl-modified silicone resin is a reaction product or a polyblend obtained from an acrylic resin and a silicone resin.

The acrylic resin includes a homopolymer of one of the radical polymerizable vinyl monomers (a) to (o) described below and copolymers comprising two or more of the monomers (a) to (o). Conventional well-known monomers that are capable of radical polymerization can be used as a radical polymerizable vinyl monomer.

(a) Hydroxyl-containing vinyl monomers, such as 2-hydroxyethyl (meth)acrylate, 2-hydroxypropyl (meth) acrylate, and maleic anhydride monoepoxy ester.

(b) Silane compounds having a radical polymerizable functional group, such as vinyltrimethoxysilane, vinyltriethoxysilane, vinylmethyldimethoxysilane, vinylmethyldiethoxysilane, 5-hexenyltrimethoxysilane, 3-(meth)acryloxypropyltrimethoxysilane, 3-(meth) acryloxypropyltriethoxysilane, 3-(meth) acryloxypropylmethyldimethoxysilane, 3-(meth) acryloxypropylmethyldiethoxysilane, 4-vinylphenyltrimethoxysilane, 3-(4-vinylphenyl) propyltrimethoxysilane, 4-vinylphenylmethyltrimethoxysilane, and styryltrimethoxysilane.

(c) (Meth)acrylic acid esters with an alkyl group having 1 to 18 carbon atoms, e.g., methyl, ethyl, propyl, isopropyl, butyl, isobutyl, octyl, 2-ethylhexyl, lauryl, stearyl or cyclohexyl.

(d) Vinyl monomers containing a carboxyl group or an anhydride thereof, such as acrylic acid, methacrylic acid, and maleic anhydride.

(e) Amido-containing vinyl monomers, such as (meth) acrylamide, N-methylol(meth)acrylamide, N-methoxymethyl(meth)acrylamide, N-butoxymethyl (meth)acrylamide, and diacetone(meth)acrylamide.

(f) Amino-containing vinyl monomers, such as dimethylaminoethyl (meth)acrylate and diethylaminoethyl (meth) acrylate.

(g) Alkoxy-containing vinyl monomers, such as methoxyethyl (meth)acrylate and butoxyethyl (meth)acrylate.

(h) Glycidyl-containing vinyl monomers, such as glycidyl (meth)acrylate and glycidyl allyl ether.

(i) Vinyl ester monomers, such as vinyl acetate and vinyl propionate.

(j) Aromatic vinyl monomers, such as styrene, vinyltoluene, and $\alpha$-methylstyrene.

(k) Vinyl cyanide monomers, such as (meth)acrylonitrile.

(l) Vinyl halide monomers, such as vinyl chloride and vinyl bromide.

(m) Vinyl monomers having at least two radical polymerizable unsaturated groups per molecule, such as divinylbenzene, allyl (meth)acrylate, ethylene glycol di(meth)acrylate, diethylene glycol di(meth)acrylate, and trimethylolpropane tri(meth)acrylate.

(n) (Poly)oxyethylene chain-containing vinyl monomers, such as (poly)oxyethylene mono(meth)acrylates containing 1 to 100 ethylene oxide groups.

(o) Diorganopolysiloxanes having 1 to 200 siloxane units and a radical polymerizable functional group at one terminal thereof, such as dimethylpolysiloxane having a (meth) acryloxypropyl group at one terminal thereof and dimethylpolysiloxane having a styryl group or an $\alpha$-methylstyryl group at one terminal thereof.

A preferred acrylic resin mainly comprises the monomers (a), (b) and (c), i.e., a hydroxyl-containing vinyl monomer, a radical polymerizable functional group-containing silane compound, and an alkyl (meth)acrylate having 1 to 18 carbon atoms in the alkyl moiety thereof.

The polymerization mode for preparing the acrylic resin is not particularly limited, and bulk polymerization, suspension polymerization, emulsion polymerization, solution polymerization or the like technique can be applied. From the viewpoint of stability and ease in carrying out polymerization, solution polymerization using alcohols, esters, ketones, aromatic hydrocarbons (e.g., xylene), etc. as a solvent is convenient.

The polymerization initiator to be used can be selected appropriately according to the polymerization mode adopted or the medium used. Useful initiators include peroxy ester type peroxides, such as t-butyl peroxyisobutyrate and t-butyl peroxyacetate; diisopropyl peroxydicarbonate, benzoyl peroxide, azobisisobutyronitrile, and dimethyl 2,2-azobis(2-methylpropionate).

The amount of the initiator to be used is subject to variation depending on the kind of the initiator, copolymerization conditions, and the like. Usually, it is used in an amount of 0.005 to 10% by weight, particularly 0.05 to 8% by weight, based on the total amount of monomers to be copolymerized.

The solvents which can be used in solution polymerization include hydrocarbons, such as toluene, xylene, n-hexane, cyclohexane, and octane; alkyl alcohols, such as methanol, ethanol, isopropyl alcohol, n-butyl alcohol, isobutyl alcohol and sec-butyl alcohol; ethers, such as ethylene glycol monoethyl ether, ethylene glycol mono-n-butyl ether, and ethylene glycol monoethyl ether acetate; acetic esters, such as ethyl acetate and butyl acetate; and ketones, such as methyl ethyl ketone, ethyl acetoacetate, acetylacetone, methyl isobutyl ketone, and acetone,.

If desired, a chain transfer agent can be used for molecular weight regulation. Examples of useful chain transfer agents are n-dodecylmercaptane, t-dodecylmercaptane, n-butylmercaptane, γ-mercaptopropyltrimethoxysilane, γ-mercaptopropyltriethoxysilane, γ-mercaptopropylmethyldimethoxysilane, and γ-mercaptopropylmethyldiethoxysilane.

The molecular weight of the acrylic resin is not particularly limited. From the standpoint of the workability and stability of the resulting curing resin composition and the appearance of the cured film, it is preferred for the acrylic resin to have a number average molecular weight of 1,000 to 100,000, particularly 2,000 to 50,000.

The silicone resins which can be used in the present invention include those represented by the following formula, for example.

$$(CH_3)_m R^1_n SiX^1_p O_{(4-m-n-p)/2}$$

wherein $R^1$ represents a substituted or unsubstituted alkyl group having 2 to 10 carbon atoms or a phenyl group; $X^1$ represents a hydroxyl group, a hydrolyzable group, or a mixture thereof; $0.32 \leqq m \leqq 1.26$; $0 \leqq n \leqq 0.54$; $0.5 \leqq m+n \leqq 1.8$; $0.64 \leqq m/(m+n) < 0.7$; and $0 < p \leqq 1.5$.

As is obvious from the relationship between m and n as defined in the above formula, 64 mol % or more and less than 70 mol % of all the organic substituents directly bonded to the Si atom are methyl groups.

With m being less than 0.32, the cured film will be too hard and easily initiate cracks. If m exceeds 1.26, the cured film will assume rubber-like properties due to its too many chain units and may have insufficient scratch resistance. A still preferred range of m is from 0.6 to 1.2. With n being more than 0.54, the high content of organic groups other than methyl not only makes the coated carrier particles less resistant to the spent-toner phenomenon but makes it difficult to secure sufficient film hardness. The limitation of (m+n) as defined above is based on the same reasons as described above with reference to m.

$R^1$ is a substituted or unsubstituted alkyl group having 2 to 10 carbon atoms or a phenyl group. The unsubstituted alkyl group includes alkyl groups, such as methyl, ethyl, propyl, isopropyl, butyl, t-butyl, hexyl, cyclohexyl, octyl, and decyl groups; alkenyl groups, such as vinyl, allyl, 5-hexenyl and 9-decenyl groups; and aryl groups, such as a phenyl group.

The substituted alkyl group includes the above-mentioned unsubstituted monohydric hydrocarbon groups having 2 to 10 carbon atoms having part or all of the hydrogen atoms thereof substituted with a substituent. The substituent includes:

(i) halogen atoms, such as fluorine and chloride, (ii) epoxy functional groups, such as a glycidyloxy group and an epoxycyclohexyl group, (iii) (meth)acryl functional groups, such as a methacrylic group and an acrylic group, (iv) amino functional groups, such as an amino group, an aminoethylamino group, a phenylamino group, and a dibutylamino group, (v) sulfur-containing functional groups, such as a mercapto group and a tetrasulfide group, (vi) alkyl ether functional groups, such as a (polyoxyalkylene)alkyl ether group, (vii) anionic groups, such as a carboxyl group and a sulfonyl group, and (viii) groups containing a quaternary ammonium salt structure.

Specific examples of the substituted monohydric hydrocarbon groups are trifluoropropyl, perfluorobutylethyl, perfluorooctylethyl, 3-chloropropyl, 2-(chloromethylphenyl)ethyl, 3-glycidyloxypropyl, 2-(3,4-epoxycyclohexyl)ethyl, 5,6-epoxyhexyl, 9,10-epoxydecyl, 3-(meth)acryloxypropyl, (meth)acryloxymethyl, 11-(meth)acryloxyundecyl, 3-aminopropyl, N-(2-aminoethyl)aminopropyl, 3-(N-phenylamino)propyl, 3-dibutylaminopropyl, 3-mercaptopropyl, 2-(4-mercaptomethylphenyl)ethyl, polyoxyethyleneoxypropyl, 3-hydroxycarbonylpropyl, and 3-tributylammoniumpropyl groups. For obtaining improved adhesion to a carrier core, it is effective to use an epoxy-, amino- or mercapto-containing functional group. Where intimate block copolymerization with a vinyl polymer is intended, it is preferred to use a radical copolymerizable (meth)acryl-containing functional group or a mercapto-containing functional group having a function as a chain transfer agent. Where crosslinking with a vinyl polymer through a linkage other than a siloxane bond is aimed at, a functional group capable of reacting with the organic functional group contained in the vinyl polymer is introduced. Such a functional group includes an epoxy group (capable of reacting with a hydroxyl group, an amino group, a carboxyl group, etc.) and an amino group (capable of reacting with an epoxy group, an acid anhydride group, etc.).

A silicone resin having incorporated therein a vinyl polymerizable group may be used to react with a vinyl polymer or in order to enhance the reactivity with a vinyl polymer.

The silanol and/or hydrolyzable group as represented by $X^1$ is an essential component, but it is not favorable that the proportion of $X^1$ as represented by p exceeds 1.5. The silicone resin having p exceeding 1.5 tends to be labile and has a small-sized molecule, and the resulting film tends to be brittle. A still preferred p for securing satisfactory storage stability and curability is in a range of from 0.05 to 0.8, particularly from 0.2 to 0.7.

The hydrolyzable group is represented by -OX, in which X is a monohydric hydrocarbon group, such as an alkyl group having 1 to 6 carbon atoms, an alkenyl group, and an aryl group. Examples of the hydrolyzable group -OX are methoxy, ethoxy, propoxy, isopropoxy, butoxy, sec-butoxy, t-butoxy, isopropenoxy, and phenoxy groups. Methoxy, ethoxy and isopropoxy groups are preferred. The silicone resins can be prepared by any process as long as the aforementioned conditions are fulfilled. A specific and preferred process is described below.

Any silane compound that contains 1 to 4 hydrolyzable groups selected from a chlorine atom and an alkoxy group and satisfies the above-mentioned conditions can be used as a starting material. Specific examples of such a silane compound include those called silane coupling agents, such as vinyltrichlorosilane, vinyltrimethoxysilane, vinyltriethoxysilane, vinylmethyldichlorosilane, vinylmethyldimethoxysilane, vinylmethyldiethoxysilane, 5-hexenyltrimethoxysilane, 3glycidoxypropyltrimethoxysilane, 3-glycidoxypropyltriethoxysilane, 3-glycidoxypropylmethyldiemthoxysilane, 3-glycidoxypropylmethyldiethoxysilane, 3-(meth) acryloxypropyltrimethoxysilane, 3-(meth) acryloxypropyltriethoxysilane, 3-(meth) acryloxypropylmethyldimethoxysilane, 3-(meth) acryloxypropylmethyldiethoxysilane, 4-vinylphenyltrimethoxysilane, 3-(4-vinylphenyl) propyltrimethoxysilane, 4-vinylphenylmethyltrimethoxysilane, 3-aminopropyltrimethoxysilane, 3-aminopropyltriethoxysilane, 3-aminopropylmethyldimethoxysilane, 3-aminopropylmethyldiethoxysilane, 3-(2-aminoethyl) aminoproyltrimethoxysilane, 3-mercaptopropyltrimethoxysilane, 3-mercaptopropyltriethoxysilane, 3-mercaptopropylmethyldimethoxysilane, and 3-mercaptopropylmethyldiethoxysilane; tetrachlorosilane, tetramethoxysilane, tetraethoxysilane, tetrabutoxysilane, methyltrichlorosilane, methyltrimethoxysilane, methyltriethoxysilane, methyltriisopropoxysilane, methyltributoxysilane, methyltriisopropenoxysilane, dimethyldichlorosilane, dimethyldimethoxysilane, dimethyldiethoxysilane, dimethyldiisopropoxysilane, dimethyldibutoxysilane, dimethyldiisopropenoxysilane, trimethylchlorosilane, trimethylmethoxyhsilane, trimethylethoxysilane, trimethylisopropenoxysilane, ethyltrichlorosilane, ethyltrimethoxysilane, propyltrichlorosilane, butyltrichlorosilane, butyltrimethoxysilane, hexyltrichlorosilane, hexyltrimethoxysilane, decyltrichlorosilane, decyltrimethoxysilane, phenyltrichlorosilane, phenyltrimethoxysilane, cyclohexyltrichlorosilane, cyclohexyltrimethoxysilane, propylmethyldichlorosilane, propylmethyldimethoxysilane, hexylmethyldichlorosilane, hexylmethyldimethoxysilane, phenylmethyldichlorosilane, phenylmethyldimethoxysilane, diphenyldichlorosilane, diphenyldimethoxysilane, dimethylphenylchlorosilane; and partial hydrolyzates of these silane compounds. Preferred of them are methoxysilane and ethoxysilane for ease of operating and of removal of by-products by evaporation. Organosilicon compounds that are applicable are not limited to these specific examples. The silane compounds can be used either individually or as a mixture of two or more thereof The silicone resin used in the present invention can be obtained by hydrolyzing the above-described hydrolyzable silane compound. Hydrolysis is carried out, for example, in an organic solvent selected from aromatic hydrocarbons, e.g., toluene and xylene; hydrocarbons, e.g., hexane and octane; ketones, e.g., methyl ethyl ketone and methyl isobutyl ketone; esters, e.g., ethyl acetate and isobutyl acetate; and alcohols, e.g., methanol, ethanol, isopropyl alcohol, butanol, isobutanol, and t-butanol.

A catalyst may be used in the hydrolysis. Conventional well-known catalysts for hydrolysis can be used. Those catalysts an aqueous solution of which assumes acidicity (pH 2 to 7) are recommended. Acidic hydrogen halides, carboxylic acids, sulfonic acids, acidic or weakly acidic inorganic salts, and solid acids such as ion-exchange resins, are particularly preferred. Examples of the preferred catalysts include hydrogen fluoride, hydrochloric acid, nitric acid, sulfuric acid, organic carboxylic acids, such as acetic acid and maleic acid, methylsulfonic acid, and cation exchange resins having a sulfo group or a carboxyl group on the surface. The catalyst for hydrolysis is preferably used in an amount of 0.001 to 10 mol per mole of the hydrolyzable groups on the silicon atom.

Addition of an aminosilane coupling agent to the acryl-modified silicone resin enhances the charging ability for toner particles, especially negatively chargeable toner particles, which is particularly effective in application to full color development involving more frequent contact between a carrier and a toner. A preferred content of the aminosilane coupling agent in the acryl-modified silicone resin is 1 to 35% by weight, particularly 20 to 35% by weight.

The aminosilane coupling agent to be added is not particularly limited in kind, and conventional widespread compounds represented by the following formula are used.

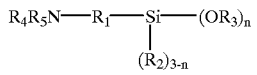

wherein $R_1$ represents an alkylene group having 1 to 4 carbon atoms or a phenylene group; $R_2$ and $R_3$ each represent an alkyl group having 1 or 2 carbon atoms; $R_4$ and $R_5$ each represent a hydrogen atom, a methyl group, an ethyl group, a phenyl group, an aminomethyl group, an aminoethyl group or an aminophenyl group; and n is 2 or 3.

Particularly preferred of them are those having a primary amino group, being represented by the following formula, for their high ability of charging a toner.

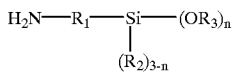

wherein $R_1$ represents an alkylene group having 1 to 4 carbon atoms; $R_2$ and $R_3$ each represent an alkyl group having 1 or 2 carbon atoms; and n is 2 or 3.

Conventionally known carriers can be used as a core material to be coated according to the present invention, such as iron powder, ferrite powder, and magnetite powder. Ferrite powder is preferred because it is easy to control the surface condition, shape, resistance, etc. of ferrite powder which are influential on the characteristics of the carrier after being coated. Mn-Mg-Sr ferrite is particularly preferred because (1) grain growth is uniformly controllable, (2) a smooth and uniform surface, which is advantageous to resin coating, can be obtained, (3) there is little variation of magnetization among particles, and (4) the carrier magnetization properties are excellent.

The carrier particles preferably have an average particle size of 25 to 60 $\mu$m and comprise small-diameter particles of 16 $\mu$m or less in a proportion of not more than 5.0% by weight. Carrier particles having an average particle size smaller than 25 $\mu$m and contain more than 5.0% by weight of small-diameter particles of 16 $\mu$m or less comprise a large proportion of fine particles of low magnetization per particle which tend to scatter during development. If the average particle size of the carrier particles exceeds 60 $\mu$m, the specific surface area decreases to reduce the ability of charging a toner.

The Mn—Mg—Si ferrite is prepared as follows. Raw materials, such as metal oxides, metal carbonates and metal hydroxides, are mixed in an appropriate ratio and wet ground together with water in a wet ball mill or a wet vibration mill, etc. for 1 hour or longer, preferably 1 to 20 hours. The slurry is dried and granulated. In some cases, the raw materials are mixed, dry ground, and then granulated. The resulting particles are calcined at 700 to 1200° C. The calcination step may be omitted when reduction in apparent density is desired. The calcined particles are again ground in a wet ball mill or a wet vibration mill to an average particle size of 15 μm or smaller, preferably 5 μm or smaller, still preferably 2 μm or smaller. If desired, a dispersant, a binder, and the like are added to the resulting slurry. After viscosity adjustment, the slurry is granulated, and the powder is fired at 1000 to 1500° C. for 1 to 24 hours. The magnetization characteristics and resistance of the ferrite can be adjusted arbitrarily by controlling the firing atmosphere, i.e., the oxygen concentration of the atmosphere. The fired product is disintegrated and screened. Small-diameter carrier core particles having an average particle size of 60 μm or smaller are obtained by classifying with an air classifier, etc. If necessary, the resulting powder can be subjected to slight reduction followed by surface oxidation in low temperature.

The coating weight of the acryl-modified silicone resin on the core is 0.03 to 5.0% by weight, preferably 0.05 to 2.0% by weight, based on the core. A coating weight less than 0.03% tends to fail to form a uniform coat on the carrier surface. A coating weight more than 5.0% forms a so thick resin coat that the coated carrier particles may agglomerate with each other, and it is difficult to obtain uniform carrier particles.

Coating of the carrier core with the acryl-modified silicone resin is usually conducted by a wet process comprising applying the resin as diluted with a solvent onto the surface of the core by dipping, spraying, brushing, kneading or a like technique and volatilizing the solvent A dry process comprising coating the core with a powdered resin is also effective.

After coating, the coating layer can be baked, if desired, either by external heating or internal heating by means of, for example, a fixed bed or fluidized bed electric oven, a rotary kiln type electric oven, a burner oven, or a microwave oven. The baking temperature preferably ranges from 150 to 300° C.

The resin-coated carrier according to the present invention is mixed with a toner to provide a tow-component developer for electrophotography. The toner to be used comprises a binder resin having dispersed therein a colorant, a charge control agent, etc.

While not limiting, the binder resin which can be used in the toner includes polystyrene, chloropolystyrene, a styrene-chlorostyrene copolymer, a styrene-acrylic ester copolymer, a styrene-methacrylic acid copolymer, a rosin-modified maleic acid resin, an epoxy resin, a polyester resin, a polyethylene resin, a polypropylene resin, and a polyurethane resin. These binder resins can be used either individually or as a mixture thereof.

The charge control agent which can be used in the toner is selected arbitrarily. Useful charge control agents for positively chargeable toners include nigrosine dyes and quaternary ammonium salts, and those for negatively chargeable toners include metallized monoazo dyes.

Any well-known dyes and pigments are useful as a colorant. Examples of suitable colorants are carbon black, Phthalocyanine Blue, Permanent Red, Chrome Yellow, and Phthalocyanine Green. The colorant is used in an amount of about 0.5 to 10 parts by weight per 100 parts by weight of the binder resin. External additives, such as fine silica powder and titania, can be added to the toner particles for improvement on fluidity and anti-agglomeration.

The method for preparing the toner is not particularly restricted. For example, a binder resin, a charge control agent and a colorant are dry blended thoroughly in a mixing machine, e.g., a Henschel mixer, and the blend is melt-kneaded in, e.g., a twin-screw extruder. After cooling, the mixture is ground, classified, and mixed with necessary additives in a mixing machine, etc.

The present invention will now be illustrated in greater detail with reference to Examples. Unless otherwise noted, all the percents are by weight.

EXAMPLE 1

Carrier core: Mn—Mg—Sr ferrite

1) Composition MnO: 40 mol %; MgO: 10 mol %; $Fe_2O_3$: 50 mol %; SrO (externally added): 0.8%

2) Particle size distribution Average particle size: 35 μm; 16 μm or smaller particles: 3.0% or less 3) Magnetization characteristics Saturation magnetization: 65 emu/g; residual magnetization: 2 emu/g; coercive force: 15 Oe Coating resin: Acryl-modified silicone resin 1) Acrylic resin Acrylic resin comprising methyl methacrylate, 2-hydroxyethyl methacrylate and methyloxypropyltrimethoxysilane 2) Organic groups in silicone resin Methyl group/(methyl group+other organic groups)=68 mol % Phenyl group/organic groups except methyl group=100 mol %

3) Acrylic resin/silicone resin=3/7 by weight

Aminosilane coupling agent added: γ-Aminopropyltriethoxysilane

The coating resin was mixed with 33% of the aminosilane coupling agent and diluted with toluene. The carrier core (Mn-Mg-Sr ferrite powder) was coated with 0.1%, on a solid basis, of the resulting resin solution and baked at 220° C. for 2 hours to obtain resin-coated carrier particles.

The resin-coated carrier was mixed with a commercially available cyan toner for a copier CF-70 (available from Minolta Co.,Ltd.) to prepare a developer having a toner concentration of 8%. The performance of the developer was evaluated by a copying test (inclusive of an environment test) using a copier CF-70 in accordance with the following methods of testing and image evaluation. The results obtained are shown in Table 3 below.

1) Developing properties (carrier fluidity)

A copying test was carried out under proper exposure conditions. The solid image density measured with a Macbeth densitometer and the solid image uniformity were graded as follows.

A. The copy is uniform with no density unevenness, reproducing the original image density very well.

B. The copy reproduces the original image density (acceptable for practical use).

C. The copy is non-uniform with density unevenness (unacceptable for practical use).

D. The copy shows considerable change from the original image density (impractical).

2) Fog

The fog due to toner stains on the white background measured with a differential calorimeter Z-300 (manufactured by Nippon Denshoku Kogyo k.k.) or its equivalent was graded as follows.

A. Less than 0.5%

B. 0.5% or higher and less than 1.5%

C. 1.5% or higher and less than 2.5%

D. 2.5% or more

3) Variation of charge quantity with environmental change

The charge quantity of the developer was measured with E-SPART ANALYZER (manufactured by Hosokawa Micron Corp.) or its equivalent. The measurement was made after the developer was allowed to stand at 10° C. and 15% RH for 24 hours ($Q_{LL}$) and after the developer was allowed to stand at 30° C. and 85% RH for 24 hours ($Q_{HH}$) to obtain the difference ΔQ ($Q_{LL}$ - $Q_{HH}$), which was rated as follows.
A. Less than 10 μC/g B. 10 μC/g or more and less than 15 μC/g C. 15 μC/g or more and less than 20 μC/g D. 20 μC/g or more 4) Variation of charge quantity during development A copying test was carried out under conditions of 20° C. and 60% RH to make 20,000 copies. The initial charge quantity of the developer ($Q_{INI}$) and the charge quantity after the running test ($Q_{20K}$) were measured with E-SPART ANALYZER or its equivalent to obtain the difference ΔQ ($Q_{INI}$ - $Q_{20K}$), which was rated as follows.

A. Less than 5 μC/g
B. 5 μC/g or more and less than 10 μC/g
C. 10 μC/g or more and less than 15 μC/g
D. 15 μC/g or more 5) Amount of spent toner Each of the initial developer and the developer after making 20,000 copies in the running test conducted in (4) above was cleared of the toner, and the thus separated carrier was analyzed to determine the carbon quantity $C_{INI\ and\ C20K}$, respectively. The rate of increase in carbon quantity (ΔC= $C_{20K}/C_{INI}$) was ranked as follows.

A. Less than 30%
B. 30% or more and less than 50%
C. 50% or more and less than 70%
D. 70% or more 6) Toner scattering After 20,000 copies were taken in the running test in (4) above, the state of the toner particles' scattering within the machine, which is problematical to image quality, was observed and graded as follows.

A. Very satisfactory
B. No problematical for practical use, although slight toner scattering is observed.
C. Problematical to image quality
D... Impractical 7) Adhesion of carrier White spots due to adhesion of carrier particles on the image area was observed and graded as follows.

A. Two or less white spots per 10 copies of A3 size
B. Three to nine white spots per 10 copies of A3 size
C. 10 to 14 white spots per 10 copies of A3 size
D. 15 or more white spots per 10 copies of A3 size 8) Overall judgement The image quality was evaluated overall to rank the carrier performance as follows.

A. Excellent
B. No problem for practical use
C. Problematical for practical use
D. Impractical

EXAMPLES 2 TO 9 AND COMPARATIVE EXAMPLE 1 TO 6

Resin-coated carriers were prepared from the carrier core and coating resin shown in Tables 1 and 2 in the same manner as in Example 1. The Cu-Zn ferrite used in Example 9 comprised 20 mol % of CuO, 25 mol % of ZnO, and 50 mol % of $Fe_2O_3$. The polyester resin used in Comparative Example 5 was a polyester resin mainly comprising a phthalic acid component.

The resulting coated carriers were each mixed with a toner to prepare a developer having a toner concentration of 8%, and the developers were tested in the same manner as in Example 1. The results obtained are shown in Tables 3 and 4.

TABLE 1

| | Carrier Core | | | Coating Resin | | | | | |
|---|---|---|---|---|---|---|---|---|---|
| | | | | | Silicone Resin | | | | |
| Example No. | Composition | Average Particle Size (μm) | 16 μm or Smaller Particles (wt %) | Modifier Resin | Modifier Resin/Silicone (by wt) | Me*/All Organic Groups (mol %) | Ph**/Organic Groups except Me (mol %) | Functional Group Other than Me and Ph | Aminosilane Coupling Agent (wt %) |
| 1 | Mn—Mg—Sr ferrite | 40 | 3 | acrylic resin | 3/7 | 68 | 100 | none | 33 |
| 2 | Mn—Mg—Sr ferrite | 40 | 3 | acrylic resin | 4/6 | 68 | 100 | none | 33 |
| 3 | Mn—Mg—Sr ferrite | 40 | 3 | acrylic resin | 2/8 | 68 | 100 | none | 33 |
| 4 | Mn—Mg—Sr ferrite | 40 | 3 | acrylic resin | 3/7 | 64 | 100 | none | 33 |
| 5 | Mn—Mg—Sr ferrite | 40 | 3 | acrylic resin | 2/8 | 68 | 80 | vinyl | 33 |
| 6 | Mn—Mg—Sr ferrite | 40 | 3 | acrylic resin | 4/6 | 68 | 100 | none | 0 |
| 7 | Mn—Mg—Sr ferrite | 25 | 7 | acrylic resin | 2/8 | 68 | 100 | none | 33 |
| 8 | Mn—Mg—Sr ferrite | 65 | 2 | acrylic resin | 4/6 | 68 | 100 | none | 33 |
| 9 | Cu—Zn ferrite | 40 | 3 | acrylic resin | 4/6 | 68 | 100 | none | 0 |

Note:
*Me: methyl group
**Ph: phenyl group

TABLE 2

| Compara. Example No. | Carrier Core: Composition | Carrier Core: Average Particle Size (μm) | Carrier Core: 16 μm or Smaller Particles (wt %) | Coating Resin: Modifier Resin | Coating Resin: Silicone Resin: Modifier Resin/Silicone (by wt) | Coating Resin: Silicone Resin: Me*/All Organic Groups (mol %) | Coating Resin: Silicone Resin: Ph**/Organic Groups except Me (mol %) | Coating Resin: Silicone Resin: Functional Group Other than Me and Ph | Coating Resin: Aminosilane Coupling Agent (wt %) |
|---|---|---|---|---|---|---|---|---|---|
| 1 | Mn—Mg—Sr ferrite | 40 | 3 | acrylic resin | 5/5 | 68 | 100 | none | 33 |
| 2 | Mn—Mg—Sr ferrite | 40 | 3 | acrylic resin | 4/6 | 62 | 100 | none | 33 |
| 3 | Mn—Mg—Sr ferrite | 40 | 3 | acrylic resin | 1/9 | 68 | 100 | none | 33 |
| 4 | Mn—Mg—Sr ferrite | 40 | 3 | acrylic resin | 4/6 | 70 | 100 | none | 33 |
| 5 | Mn—Mg—Sr ferrite | 40 | 3 | polyester | 4/6 | 68 | 100 | none | 33 |
| 6 | Mn—Mg—Sr ferrite | 40 | 10 | acrylic resin | 4/6 | 62 | 100 | none | 33 |

Note
*Me: methyl group
**Ph: phenyl group

TABLE 3

| Example No. | Developing Properties | Fog | Variation of Charge Quantity: Due to Environment | Variation of Charge Quantity: Due to Development | Spent Toner | Toner Scattering | Adhesion of Carrier | Overall Judgement |
|---|---|---|---|---|---|---|---|---|
| 1 | A | A | A | A | A | A | B | A |
| 2 | B | A | B | B | B | B | B | B |
| 3 | A | B | A | B | A | B | B | B |
| 4 | B | B | A | B | B | B | B | B |
| 5 | B | C | C | B | B | C | B | C |
| 6 | B | C | C | B | C | C | B | C |
| 7 | A | C | B | B | B | B | C | C |
| 8 | B | C | B | B | C | C | A | C |
| 9 | C | C | C | C | C | C | C | C |

TABLE 4

| Compara. Example No. | Developing Properties | Fog | Variation of Charge Quantity: Due to Environment | Variation of Charge Quantity: Due to Development | Spent Toner | Toner Scattering | Adhesion of Carrier | Overall Judgement |
|---|---|---|---|---|---|---|---|---|
| 1 | D | C | C | C | D | D | B | D |
| 2 | D | D | B | D | D | D | B | D |
| 3 | C | D | C | D | C | C | B | D |
| 4 | C | D | C | D | B | D | B | D |
| 5 | C | D | D | D | D | D | B | D |
| 6 | C | D | D | D | D | D | D | D |

What is claimed is:

1. A resin-coated carrier for an electrophotographic developer which comprises a carrier core coated with an acryl-modified silicone resin the silicone resin of which has a methyl group and other organic groups, the molar ratio of the methyl group to the total organic groups inclusive of the methyl group, methyl group, methyl group+other organic groups being 64 mol % or higher and lower than 70 mol %, and the acrylic resin to silicone resin weight ratio ranging from 2/8 to 4/6.

2. A resin-coated carrier according to claim 1, wherein the ratio of a phenyl group to the organic groups except the methyl group in said acryl-modified silicone resin is 90 mol % or more.

3. A resin-coated carrier according to claim 1, wherein said acryl-modified silicone resin contains 1 to 35% by weight of an aminosilane coupling agent.

4. A resin-coated carrier according to claim 1, wherein said carrier core is Mn—Mg—Sr ferrite which has an average particle size of 25 to 60 μm, and the proportion of small particles of 16 μm or smaller in said carrier core is 5.0% by weight or less.

5. An electrophotographic developer comprising a resin-coated carrier according to claim 1 and a nonmagnetic toner.

6. An electrophotographic developer comprising a resin-coated carrier according to claim 2 and a nonmagnetic toner.

7. An electrophotographic developer comprising a resin-coated carrier according to claim 3 and a nonmagnetic toner.

8. An electrophotographic developer comprising a resin-coated carrier according to claim 4 and a nonmagnetic toner.

* * * * *